US006921075B2

(12) United States Patent
Moore

(10) Patent No.: US 6,921,075 B2
(45) Date of Patent: Jul. 26, 2005

(54) THEME-BASED CARD GAMES HAVING SUBJECTIVE SCORING CRITERIA

(76) Inventor: Brian L. Moore, 230 Cresent Hill Dr., Ortonville, MI (US) 48462

( * ) Notice: Subject to any disclaimer, the term of this patent is extended or adjusted under 35 U.S.C. 154(b) by 85 days.

(21) Appl. No.: 10/673,878

(22) Filed: Sep. 29, 2003

(65) Prior Publication Data

US 2005/0067783 A1 Mar. 31, 2005

(51) Int. Cl.[7] ..... A63F 1/00
(52) U.S. Cl. ..... 273/292; 273/308
(58) Field of Search ..... 273/292, 293, 273/296, 298, 300, 301, 302, 308; 434/129

(56) References Cited

U.S. PATENT DOCUMENTS 4,252,321 A 2/1981 Hopwood
4,822,043 A 4/1989 Carter
5,026,072 A * 6/1991 Ayisi ..... 273/308
5,076,588 A 12/1991 Minh
5,318,306 A * 6/1994 Levin ..... 273/293
5,451,062 A * 9/1995 Malone ..... 273/292
5,467,997 A 11/1995 Bashirzadeh
5,653,445 A 8/1997 Quach
5,678,822 A * 10/1997 Setteducati ..... 273/296
5,692,750 A * 12/1997 Poole ..... 273/161
5,813,673 A 9/1998 Richardson
6,179,294 B1 * 1/2001 Turnali ..... 273/302
6,270,077 B1 * 8/2001 Cohen ..... 273/273
6,328,308 B1 12/2001 Kirby
6,412,779 B1 * 7/2002 Kenney ..... 273/292
6,715,762 B2 * 4/2004 Simmons ..... 273/429

* cited by examiner

*Primary Examiner*—Kurt Fernstrom
(74) *Attorney, Agent, or Firm*—TraskBritt

(57) ABSTRACT

Card games for two or more players using a deck of cards having a common theme are disclosed. Each card of the deck is printed on one side with a different image of a person or thing that is a member of a class of items related to the theme of the game. Players score by comparing cards from each player's hand and subjectively deciding which cards prevail in a round of cards. The decision as to the best card is determined by agreement of a majority of players. If a majority of players cannot agree, a neutral nonplayer may be consulted to subjectively decide the best card for a round. If a neutral nonplayer cannot decide or is not available, the players resort to an alternative basis for determining the winner of an undecided round. Additional aspects of game play may be decided by using textual information printed on the cards.

23 Claims, 6 Drawing Sheets

THEME-BASED CARD GAMES HAVING SUBJECTIVE SCORING CRITERIA

BACKGROUND OF THE INVENTION

1. Field of the Invention

The present invention relates generally to the field of card games. More specifically, the present invention relates to embodiments of theme-based card games for two or more players wherein points are scored by comparing cards from each player's hand and subjectively deciding which cards prevail.

2. State of the Art

Card games have long been a favorite pastime for both adults and children, and a multitude of different games have been developed over the years in order to accommodate the varied interests of players. Many well-known games, for example, have been adapted for playing with a standard deck of fifty-two cards containing four suits of thirteen cards from ace through king in each suit. Another popular class of games involves using decks of cards that are based on a particular common theme, such as sports, geography, fictional characters, or any other general topic of interest. The playing cards for these theme-based games typically include pictorial and/or statistical information related to various aspects of the game theme, with the statistical information on each card determining the value of the card or the outcome of game variables.

U.S. Pat. No. 5,467,997 to Bashirzadeh discloses an example of a theme-based game using a deck of informational playing cards printed with a particular class of items within a given theme. Each card contains a picture representing a member of the class, for instance, a sports team or a geographical location, and a list of statistics relating to that specific class member. Players are dealt a hand of cards from the deck, and a series of rounds commences wherein the players try to win cards from each other based on a selected statistical category. In each round, the player having a card with the best numerical value for that statistical category prevails and takes the other players' cards. The player having the most cards at the end of a predetermined period of play wins the game. U.S. Pat. No. 4,822,043 to Carter discloses another theme-based card game that simulates the playing of baseball. Teams are formed from a set of player cards, with each player card including statistics for an individual baseball player, such as run production rate, stealing frequency, injury ratings, and fielding capabilities. Rolls of dice establish which statistical data on a card is used to govern the outcome of various plays. Comparisons of the selected data on offensive and defensive player cards then determine whether a play results in a hit, steal, run, out, or other possible play outcome.

While card games of the type described above offer some degree of variability, they rely primarily on comparisons between set values printed on each card to determine the outcome of game play. Accordingly, players' results are generally bound by the cards they receive, which may be based solely on the random result of tossing a die or drawing a card from a shuffled deck. Such limitations do not allow a player's subjective input to exert any control over game play. In view of the foregoing, providing a theme-based card game wherein players subjectively decide the value of a card rather than using set values would increase interaction between players and make the game more entertaining.

BRIEF SUMMARY OF THE INVENTION

In accordance with the present invention, theme-based card games for two or more players are disclosed wherein the value of cards is determined on a subjective basis. In basic form, the games involve providing a deck of playing cards having a common theme. Each card of the deck is printed on one side with a different image of a person or thing that is a member of a class of items related to the theme of the game. Players are each dealt a hand of cards from the deck, and the game progresses through a series of rounds wherein comparisons are made between the players' cards. For each round, the players decide amongst themselves which cards are superior to other cards, based solely on the players' subjective opinions about the values of their cards. The player having the best card wins the round and takes the other players' cards or scores points. If a majority of players cannot agree to the value of one or more cards in a given round, the players then refer to a neutral party to make the decision for that round. If a neutral party cannot decide which card is the best, the players may conduct a tie-breaking round with additional cards, wherein the player with the best card wins both the tie-breaking round and the previous, undecided round. Alternatively, multiple players having equally superior cards may split points for the round. The player winning the most rounds for a predetermined period of play wins the game.

Different game embodiments may be provided by combining the basic premise for game play described above with additional rules or tactics. While certain embodiments are hereinafter depicted and described to illustrate possible variations of the basic game premise, it should be understood that the specific embodiments are only exemplary, and that any number of theme-based game variants may be developed using the broad concept of subjectively determining the value of cards compared during game play.

In a first exemplary embodiment of the present invention, all the cards from the deck are dealt to the players in equal hands. The players then compare their respective cards, one at a time, and decide amongst themselves who has the best card for each round of comparisons. The player with the best card then takes the other players' cards for that round. If the players cannot decide which card is best, a designated neutral party is consulted to make the decision. If there is no neutral party to consult, or the third party cannot decide, the players conduct a tie-breaking round with additional cards and the player with the best card takes all the other cards for both rounds. The game continues until one player has taken all the cards.

In a second exemplary embodiment of the present invention, each player is dealt a hand with a set number of cards, and the remainder of the deck is placed in a facedown stack. The players are then given the opportunity to discard and draw additional cards from the stack in an attempt to improve their hands. Once the drawing phase is complete, the players compare hands. A determination is made as to which player has the best hand of cards using the same criteria as in the first embodiment and that player wins the hand. Each hand counts as a point, and the winner is the player who wins the most hands out of a predetermined number.

In a third exemplary embodiment of the present invention, players draw hands from a deck with the goal of putting together the most formidable lineup of members of a class related to the theme of the game, such as a sports team. In a manner similar to the second embodiment, the players may then discard and draw additional cards from a stack or remaining cards to improve their lineup. Once the drawing phase is complete, the players compare cards, one at a time or all at once, using the above-described subjective criteria to determine who has the best lineup. The player with the best lineup wins the game.

Other and further features and advantages of the present invention will be apparent from the following descriptions of the various embodiments when read in conjunction with the accompanying drawings. It will be understood by one of ordinary skill in the art that the following embodiments are provided for illustrative and exemplary purposes only, and that numerous combinations or modifications to the elements thereof are possible.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1A:
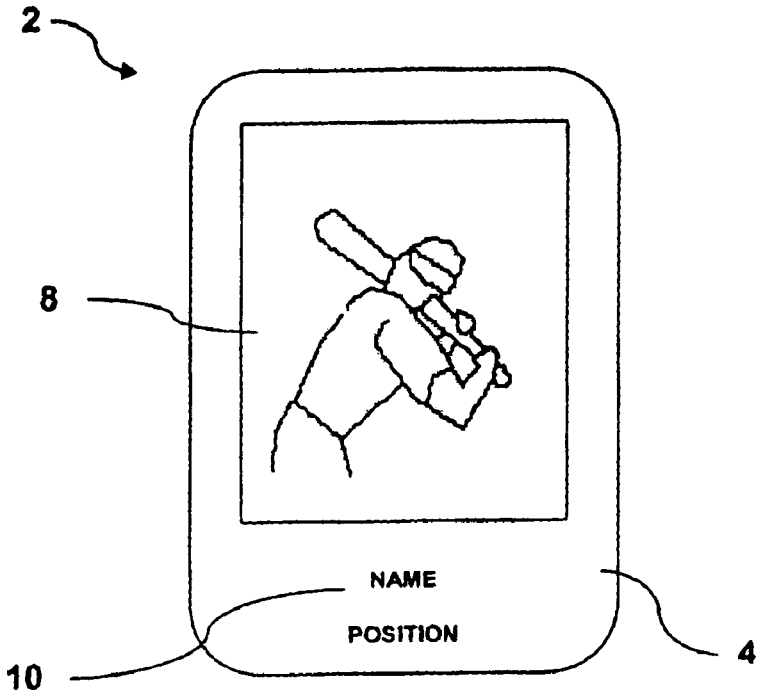
FIG. 1A is front view of an exemplary playing card according to the present invention.

Referring initially to the drawings, various aspects of the present invention are illustrated to show exemplary game embodiments wherein subjective criteria are used to determine the value of playing cards. Common elements of the illustrated embodiments are designated with like reference numerals for clarity. It should be understood that the drawings are not meant to be illustrative of actual views of any particular playing cards used in conjunction with the embodiments of the present invention, but are merely idealized schematic representations which are employed to more clearly and fully depict the invention.

Figure 1B:
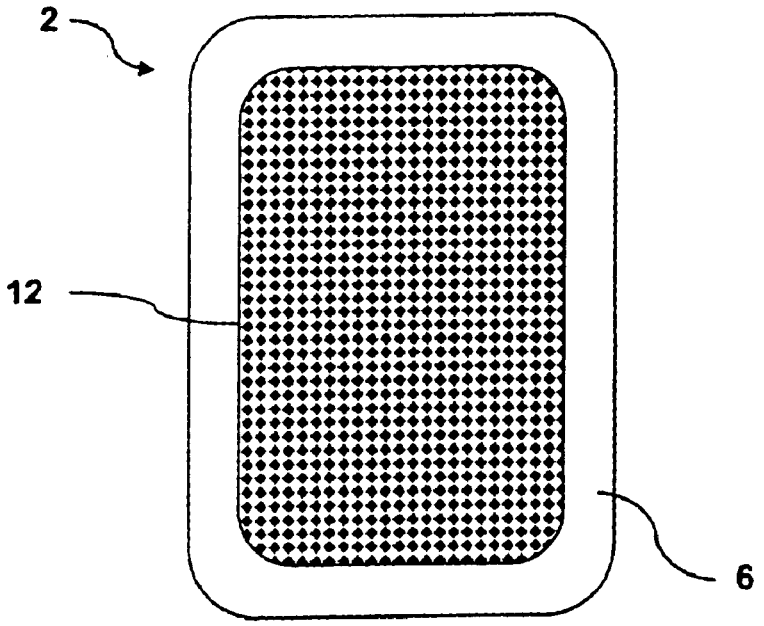
FIG. 1B is a back view of the playing card depicted in FIG. 1.

FIGS. 1A–1B show a playing card 2 embodying the principles of the present invention. Playing card 2 represents one card of a deck of cards having a common theme for a game. The game theme may involve any general topic of interest, including but not limited to, sports, geography, movies, music, history, food, celebrity personas, or even a fictional subject such as a fantasy or role-playing game. As seen in FIGS. 1A and 1B, playing card 2 has a front surface 4 and an opposing back surface 6. While playing card 2 is depicted as having a conventional rectangular shape, any shape is acceptable, as long as all the cards in a deck are formed with the same shape. FIG. 1A shows that the front surface 4 of playing card 2 is printed with an image 8 depicting one member of a class of items related to the theme of the game. If the theme of the game is sports, for example, the class of items may comprise members of baseball, basketball, or football teams, with each playing card 2 in the deck having an image 8 of a different team member. Front surface 4 may also include textual information 10, such as a name or position when image 8 depicts a member of a sports team. In contrast to prior art playing cards, textual information 10 is not for the purposes of assigning any value to playing card 2, but is instead used to assist in identifying the individual class member printed on image 8. It should be understood that "textual information" as used herein is not intended to be limited to actual text, but may include any symbol or indicia that further identifies the class member. FIG. 1B shows that the back surface 6 of playing card 2 may also be printed with an image 12, which may comprise a decorative design or pattern, or possibly the name of the game. As with the shape of the cards, any form of indicia may be used for image 12, as long as back surface 6 of all the cards in a deck appear substantially the same. Alternatively, back surface 6 may be left blank.

Figure 2:
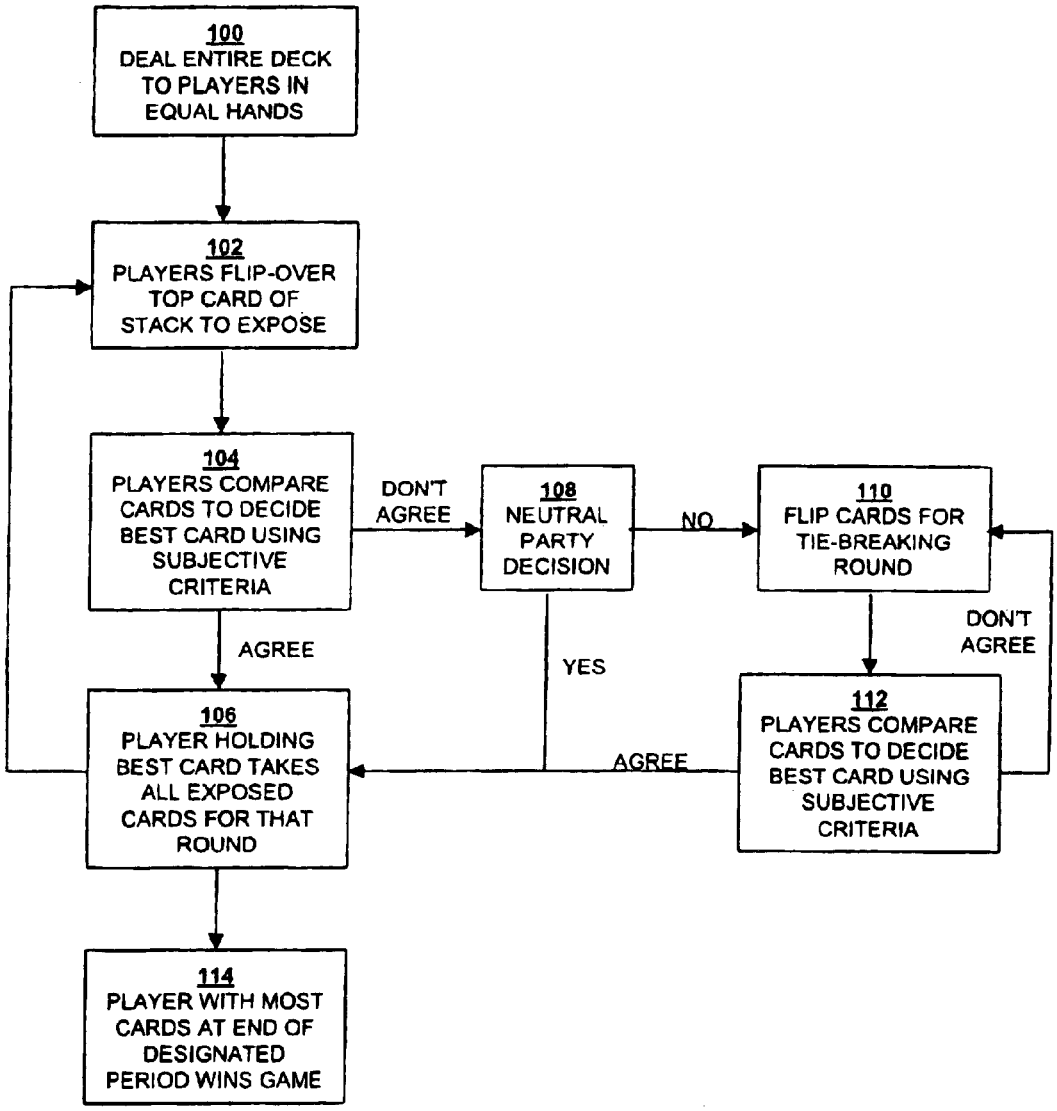
FIG. 2 is flow chart illustrating a method of play according to a first exemplary game embodiment of the present invention.

FIG. 2 is a flow chart showing how a deck of playing cards 2 may be used to play a game according to a first exemplary embodiment of the present invention. The game begins at block 100 with the entire deck being dealt to two or more players in equal hands. Each player's hand is placed in a facedown stack, such that players can only see back surface 6 of playing cards 2. In block 102, the players simultaneously flip over the top playing card 2 of their stack to expose front surface 4 of that card. At this point, shown by block 104, the players compare each of their respective playing cards 2 and decide amongst themselves which of the exposed cards is superior by examining image 8. The decision as to the best playing card 2 is founded solely on the players' subjective opinions about the value associated with image 8 on each card. In a game where the theme is movies, for example, image 8 of each playing card 2 may comprise a different movie, with the players deciding which movie is their favorite. If a majority of players agree which playing card 2 is superior to the others, the player holding that card takes all the exposed cards for that round and incorporates them into his or her stack, as indicated by block 106.

In block 108, if a majority of players cannot agree to the value of one or more cards, the players then ask a neutral party to make the decision for them. The neutral party may be any person who is not a player in the game, and whose decision the players have agreed to abide by. The neutral party also makes the decision as to the best playing card 2 by using their own subjective opinion about the value associated with image 8 on each card. Once the neutral party has decided which playing card 2 is superior to the others, the player holding that card takes all the exposed cards and incorporates them into his or her stack. In the event the neutral party cannot decide which is the best card for that round, or if there is no neutral party to consult, the players may conduct a tie-breaking round, shown in block 110 of FIG. 2, wherein the players simultaneously flip over another playing card 2 from the top of each of their stacks. In block 112, the players compare the cards and subjectively determine which card is superior. The player holding that card takes all the exposed cards for the tie-breaking round and the undecided round and incorporates them into his or her stack. If the players cannot decide which card is superior in a tie-breaking round, they may play additional tie-breaking rounds until a majority decision can be made for a round, with the player holding the best card in the decisive round taking all of the exposed cards.

Once a player has won a round and taken the exposed cards, consecutive rounds are played in the same manner shown by blocks 102 through 112 in FIG. 2. Game play continues for a designated period, such as until a player has taken all of the other players' cards. At that point, as indicated by block 114, the player with the most cards wins the game.

Figure 3:
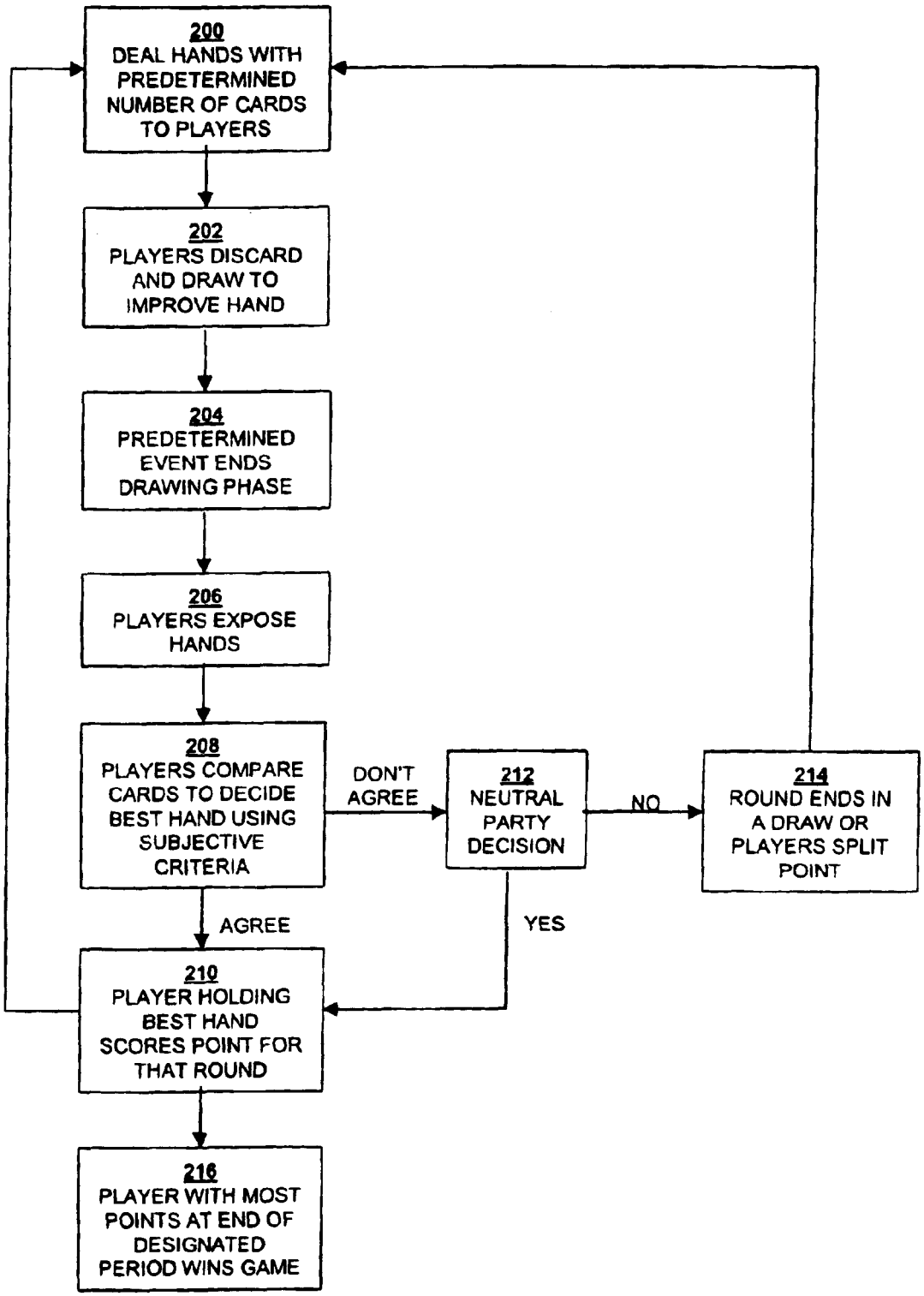
FIG. 3 is a flow chart illustrating a method of play according to a second exemplary game embodiment of the present invention.

FIG. 3 is a flow chart showing how a deck of playing cards 2 may be used to play another game according to a second exemplary embodiment of the present invention, wherein players have the opportunity to discard and draw additional cards. Beginning with block 200, each player is dealt a hand comprising a predetermined number of playing cards 2, and the remainder of the deck is placed facedown in a draw-stack. The number of playing cards 2 in a hand may be set using any predetermined criteria, such as by dealing a number of cards to each player that emulates a known game played with a conventional fifty-two card deck. Block 202 shows that players are then given consecutive turns to discard cards that are, in a player's subjective view, undesirable faceup into a discard pile and to replace them with cards drawn from the draw-stack or discard pile. Players continue taking turns until a predetermined event ends the drawing phase in block 204, for example, when completing a set number of draws. Alternatively, and by way of further example, the drawing phase may end when one player feels confident with his or her hand and "calls" in a conventional manner, with the other players having one additional opportunity to discard and draw after the call is made.

At this point, as shown in blocks 206 and 208, the players expose their hands and decide which hand is superior by comparing the playing cards 2 contained within each hand. Again, the decision as to the best hand is founded solely on the players' subjective opinions about the value associated with image 8 on each playing card 2. In a game where the theme is basketball, for example, image 8 of each playing card 2 may comprise a different basketball player, with the players deciding which hand contains the best group of athletes. If a majority of players agree which hand is superior to the others, the player holding that hand scores a point for that round, as indicated by block 210.

In block 212, if a majority of players cannot agree as to the values of their respective hands, the players then ask a neutral party to make the decision for them in the same manner as in the first embodiment of the present invention. The player holding the hand that the neutral party considers best takes the point. In the event the neutral party cannot decide which is the best hand for that round, or if there is no neutral party to consult, the players may consider the round a draw, with no points scored, shown by block 214 of FIG. 3, or the players may each draw an additional card from the stack to break the draw. Alternatively, if two or more hands are considered equally good but superior to the remaining hands, the players holding those hands may split the point.

Once the round is decided, consecutive rounds are played with the dealing, drawing phase, and comparison of hands carried out in the same manner shown by blocks 200 through 214 in FIG. 3. Game play continues for a designated period, such as by completing a predetermined number of rounds. At that point, as indicated by block 216, the player with the most points wins the game.

Figure 4:
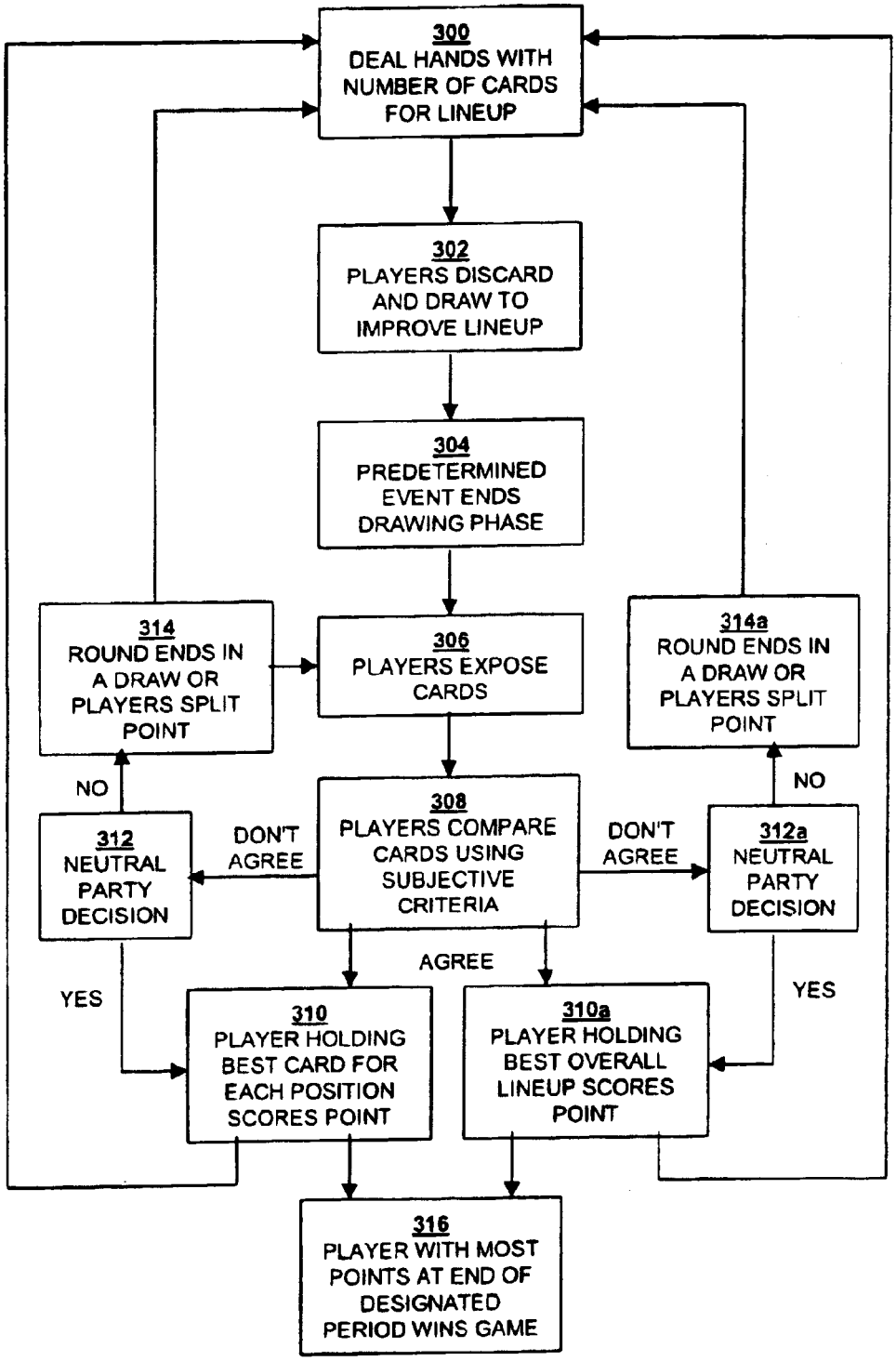
FIG. 4 is a flow chart illustrating a method of play according to a third exemplary game embodiment of the present invention.
Figure 5:
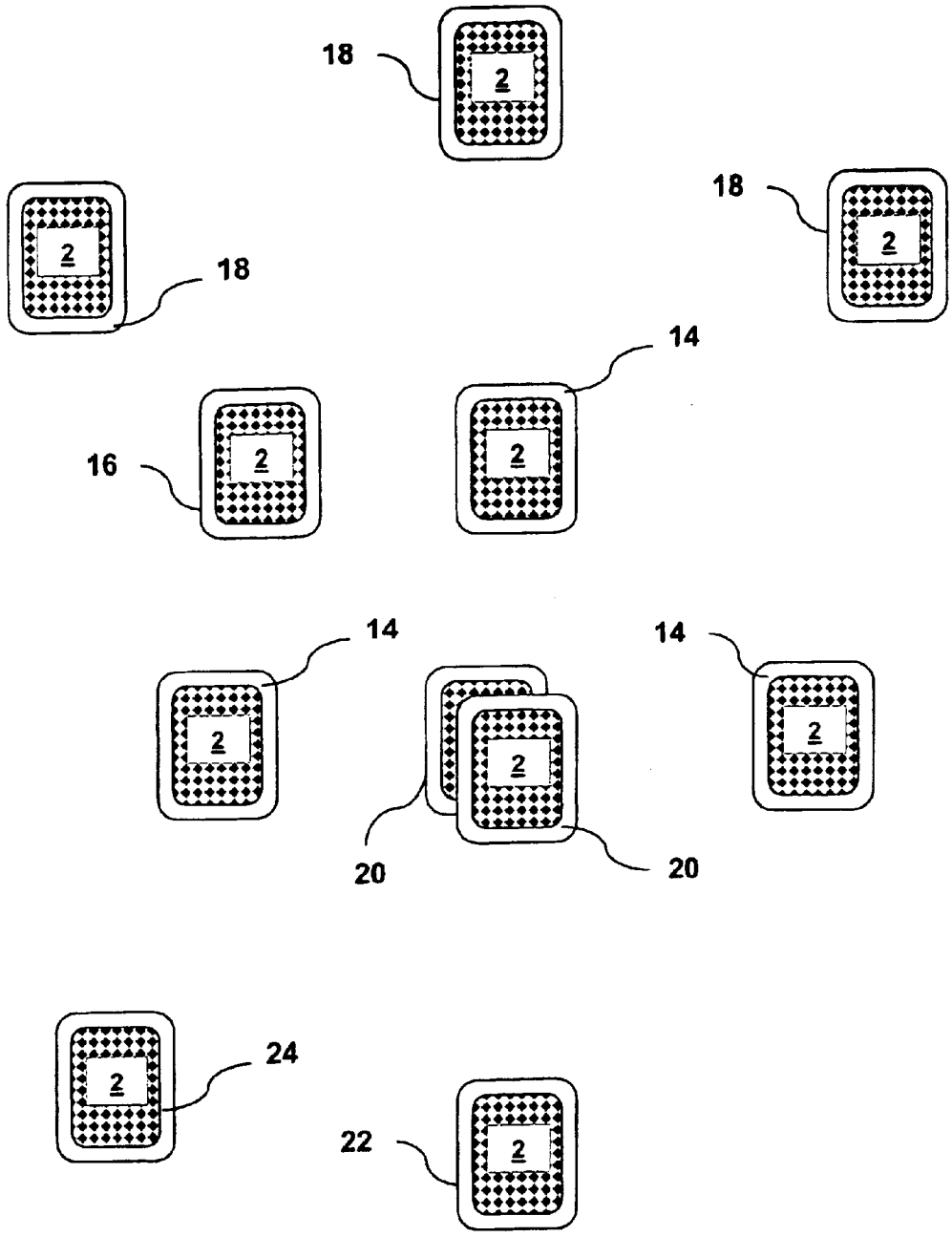
FIG. 5 is a top view of playing cards laid out in a pattern corresponding to a lineup according to the third embodiment of the present invention.

FIG. 4 is a flow chart showing how a deck of playing cards 2 may be used to play another game according to a third exemplary embodiment of the present invention, wherein players are dealt hands based on a lineup of class members related to the theme of the game, such as a sports team. The goal is for each player to put together a lineup that he or she thinks will be the most formidable, and then to subjectively compare hands to determine which player has the best lineup. Block 300 in FIG. 4 shows that the game begins by dealing each player a hand comprising a number of playing cards 2 corresponding to the lineup for the game theme, with the remainder of the deck being placed face-down in a draw-stack. The players may hold their respective hands or, if desired, the cards of each hand may be laid out on a playing surface in a pattern that relates to the lineup of the game theme. FIG. 5 shows that if the game theme involves baseball, for example, the players may lay down each of their playing cards 2 in a spot a corresponding to a team position around a baseball diamond. FIG. 5 shows that a baseball hand may comprise eleven playing cards 2 set in spots representing base positions 14, shortstop position 16, outfield positions 18, two starting pitchers 20, a catcher 22, and a relief pitcher 24.

Returning to FIG. 4, block 302 shows that players are then given consecutive turns to discard cards that are considered undesirable faceup into a discard pile, and to replace them with cards drawn from the draw-stack or discard pile. Players continue taking turns until a predetermined event ends the drawing phase in block 304, such as the number of draws or a player calling in the manner described in the second embodiment. At this point, as shown in block 306, the players expose their respective lineups by flipping over their playing cards 2, one at a time or all at once. The players then compare each of their respective playing cards 2, shown in block 308, and decide amongst themselves which of the exposed cards is superior by examining image 8. With the baseball-themed game, for example, image 8 of each playing card 2 comprises a different baseball player, with the players deciding which hand has a lineup forming the best baseball team. If cards are exposed and compared one at a time as in block 310, the game may be scored by deciding who has the superior card for each position in the lineup, with a point being awarded for every position. If cards are exposed and compared all at once as in block 310*a*, the game may be scored by deciding who has the best overall lineup, with that player receiving a single point.

If a majority of players cannot agree which cards or lineups are superior to the others, blocks 312, 312*a* show that the players then ask a neutral party to make the decision for them in the same manner as in the first and second embodiments of the present invention. Absent a neutral party decision, the comparison may result in a draw with no points scored or the players with the best cards may split the point, as shown blocks 314, 314*a* of FIG. 4, or the players may each draw an additional card from the stack to break the draw. Once again, consecutive rounds are played by dealing hands, discarding and drawing, and comparing individual positions or entire lineups in the same manner shown by blocks 300 through 314*a* in FIG. 4. Game play continues for a designated period, and at block 316 the player with the most points at the end of the designated period wins the game.

Figure 6:
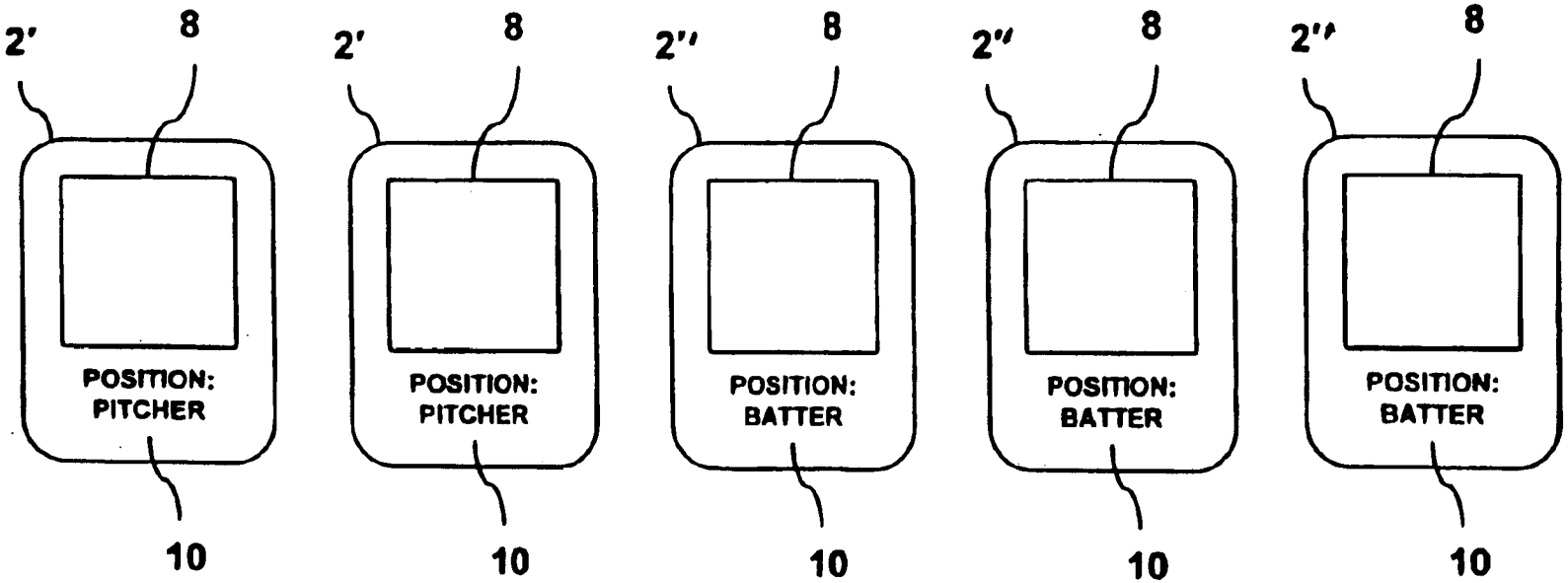
FIG. 6 is a top view illustrating a player's hand having a specific combination of based on textual information printed on the cards.

While the above exemplary embodiments have been described in terms of deciding the value of playing cards 2 based solely on subjective criteria, it is also within the scope of the present invention that set values indicated by textual information 10 on playing cards 2 may be used to determine additional aspects of game play. During the drawing phase of the second embodiment shown in block 202 of FIG. 3, for example, an additional aspect of game play may require each player to acquire a hand comprising a specific combination of cards based on textual information 10. FIG. 6 shows an example of such a combination in a baseball-themed game according to this variant of the second embodiment, wherein the goal is to acquire a hand with two playing cards 2' having textual information 10 indicating "pitcher" positions and three playing cards 2" having textual information 10 indicating "batter" positions. The drawing phase continues until one player acquires a hand with the required combination that he or she feels is worth showing. In block 204 of FIG. 3, the player then calls the round, with the other players having one additional opportunity to discard and draw after the call is made. At this point, any players not having a hand with the required combination of cards must fold. The remaining players then subjectively compare their hands to score points as previously described with respect to blocks 206 through 214.

The third embodiment may also be adapted to include additional aspects of game play based on set values in textual information 10. With the baseball-themed game, for example, the players may be required to hold a hand with playing cards 2 having textual information 10 corresponding to each position in the baseball team in order to complete a lineup. As previously described with respect to block 302 of FIG. 4, the players take consecutive turns discarding cards that are undesirable or lack textual information 10 indicating team positions needed to complete a lineup and replacing them with cards drawn from the draw-stack or discard pile. Each turn consists of drawing one card from the draw-stack or discard pile and then discarding one card faceup into the discard pile. During each turn, a player also lays down one card into the lineup pattern shown in FIG. 5, unless they do not have a playing card 2 with textual information 10 corresponding to an open team position in the pattern. Once a player has laid his or her entire hand down to complete their lineup pattern, the drawing phase enters an "open draft" stage. When another player selects a card from the draw-stack or discard pile during this stage, the player with the complete lineup has the right to take that card, exchange it for a card in their lineup, and discard their old card. The other player may then complete his or her turn by taking the old card or drawing from the draw-stack. The drawing phase continues until all players have completed their lineups, at which point the players subjectively compare their hands to score points as previously described with respect to blocks 306 through 314 or 314*a*.

Each of the above-illustrated embodiments and variations thereof of the present invention provides an exemplary card game wherein players score by comparing cards and subjectively deciding which player's hand prevails. Although the present invention has been depicted and described with respect to the illustrated embodiments, various additions, deletions and modifications are contemplated within its scope. The scope of the invention is, therefore, indicated by the appended claims rather than the foregoing description. All changes which come within the meaning and range of equivalency of the claims are to be embraced within their scope.

What is claimed is:

1. A method of playing a card game among two or more players, comprising:

providing a plurality of playing cards, wherein each playing card of the plurality of playing cards has a front surface printed with an image depicting one class member of a class of items related to a theme of the card game and an opposing, back surface;

dealing a predetermined number of the plurality of playing cards to each player to create a hand of playing cards for each player;

in a plurality of rounds of playing cards, comparing in each round at least one playing card from the hand of playing cards of each player;

determining a winner of each round from the comparison, wherein:

each player decides which playing card of a round is a best playing card based on a subjective opinion of each player about a value of the class member depicted by the image on each playing card;

if a majority of players agree which playing card of the round is the best playing card, a player holding the best playing card according to the majority of players wins the round;

if the majority of players do not agree which playing card of the round is the best playing card, the two or more players refer to a neutral nonplayer for a decision, wherein the neutral nonplayer is to decide which playing card of the round is the best playing card based on a subjective opinion of the neutral nonplayer about the value of the class member depicted by the image on each playing card, and a player holding the best playing card according to the subjective opinion of the neutral nonplayer wins the round;

if the two or more players refer to the neutral nonplayer for the decision and a neutral nonplayer decision cannot be obtained, the two or more players resort to an alternative basis for determining a winner of an undecided round; and declaring a player the winner of the card game.

2. The method of claim 1, further comprising:

placing the hand of each player in a facedown stack;

simultaneously flipping over a top playing card of the stack of each player to expose the front surface of the top playing card and provide an initial round of playing cards of the plurality of rounds of playing cards; and simultaneously flipping over at least another top playing card of the stack of each player to provide at least another round of playing cards of the plurality of rounds of playing cards.

3. The method of claim 1, wherein the winner of a round of playing cards takes all of the playing cards for that round and incorporates all of the playing cards into his or her hand.

4. The method of claim 3, wherein comparing at least one playing card from the hand of playing cards of each player in a plurality of rounds of playing cards comprises continuing to compare rounds of playing cards until one player has won enough rounds to take all of the plurality of playing cards, and wherein the one player taking all of the plurality of playing cards is declared the winner of the card game.

5. The method of claim 1, wherein resorting to an alternative basis for determining the winner of an undecided round comprises:

comparing playing cards between players in at least one additional round of the plurality of rounds of playing cards;

determining a winner of at least one additional round; and declaring the winner of the at least one additional round the winner of the undecided round.

6. The method of claim 1, further comprising:

placing a number of the plurality of playing cards facedown in a draw-stack; and conducting a drawing phase wherein the two or more players are provided consecutive turns to discard at least one playing card from the hand of playing cards of each player into a discard pile and to replace the at least one discarded playing card with at least one playing card drawn from the draw-stack or the discard pile.

7. The method of claim 6, further comprising:

continuing the consecutive turns for each player in the drawing phase until the occurrence of a predetermined event; and ending the drawing phase upon the occurrence of the predetermined event.

8. The method of claim 7, wherein ending the drawing phase comprises conducting a predetermined number of consecutive turns for each player.

9. The method of claim 7, wherein ending the drawing phase comprises calling by one player and providing each of the other players one additional turn to discard at least one playing card from the hand of playing cards of each player into the discard pile and to replace the at least one discarded playing card with at least one playing card drawn from the draw-stack or the discard pile.

10. The method of claim 1, further comprising:

dealing an initial hand of playing cards to each player to provide initial rounds of playing cards of the plurality of rounds of playing cards; and dealing at least another hand of playing cards to each player to provide additional rounds of playing cards of the plurality of rounds of playing cards.

11. The method of claim 10, wherein a player winning a majority of rounds of playing cards within each hand of playing cards scores a point for that hand.

12. The method of claim 11, further comprising splitting a point for a hand when resorting to an alternative basis for determining the winner of an undecided round in that hand.

13. The method of claim 11, further comprising considering a hand a draw when resorting to an alternative basis for determining the winner of an undecided round in that hand.

14. The method of claim 11, wherein a player scoring the most points after a designated period of play is declared the winner of the card game.

15. The method of claim 1, wherein dealing a predetermined number of the plurality of playing cards to each player to create a hand of playing cards for each player comprises dealing a number of playing cards corresponding to a lineup of class members related to the theme of the card game.

16. The method of claim 15, further comprising laying out the playing cards of the hand of playing cards of each player facedown on a playing surface in a pattern that relates to the lineup related to the theme of the card game.

17. The method of claim 16, further comprising:

simultaneously flipping over one playing card of the hand of playing cards of each player to expose the front surface thereof and provide an initial round of playing cards of the plurality of rounds of playing cards; and simultaneously flipping over at least another playing card of the hand of playing cards of each player to provide at least another round of playing cards of the plurality of rounds of playing cards.

18. The method of claim 17, wherein the winner of a round of playing cards scores a point, and a player scoring the most points after a designated period of play is declared the winner of the card game.

19. The method of claim 16, wherein a player winning a majority of rounds of playing cards within each hand of playing cards scores a point for that hand.

20. The method of claim 1, wherein the front surface of each playing card of the plurality of playing cards is printed with textual information, and further comprising: using the textual information to determine additional aspects of game play.

21. The method of claim 20, wherein using the textual information to determine additional aspects of game play comprises requiring each player to acquire a hand comprising a specific combination of cards based on the textual information.

22. The method of claim 20, wherein using the textual information to determine additional aspects of game play comprises requiring each player to acquire a hand with each playing card of the hand corresponding to a position in a lineup of class members related to the theme of the card game.

23. The method of claim 1, wherein the image depicting one class member printed on each playing card of the plurality of playing cards comprises (on each card) a members member of a sports team.

* * * * *